US009016500B1

(12) United States Patent
Rossi

(10) Patent No.: US 9,016,500 B1
(45) Date of Patent: Apr. 28, 2015

(54) CAP WITH MULTIPLE FUNCTIONALITY

(71) Applicant: Thomas Ralph Rossi, Newport Beach, CA (US)

(72) Inventor: Thomas Ralph Rossi, Newport Beach, CA (US)

( * ) Notice: Subject to any disclaimer, the term of this patent is extended or adjusted under 35 U.S.C. 154(b) by 0 days.

(21) Appl. No.: 13/875,768

(22) Filed: May 2, 2013

Related U.S. Application Data

(60) Provisional application No. 61/796,475, filed on Nov. 13, 2012.

(51) Int. Cl.
*B65D 51/24* (2006.01)

(52) U.S. Cl.
CPC ..... *B65D 51/24* (2013.01)

(58) Field of Classification Search
CPC ..... B65D 51/24
USPC ..... 220/212, 751, 4.01, 4.26, 4.27, 253, 220/388, 796; 215/228, 390; 224/148.7, 224/269
See application file for complete search history.

(56) References Cited

U.S. PATENT DOCUMENTS

| | | | | |
|---|---|---|---|---|
| 4,258,857 | A * | 3/1981 | McGee | 220/212 |
| 6,782,576 | B1 * | 8/2004 | Valencic et al. | 7/158 |
| 7,887,211 | B2 * | 2/2011 | Summers | 362/102 |
| 2005/0017004 | A1 * | 1/2005 | Schlatter | 220/212 |
| 2005/0166937 | A1 * | 8/2005 | Taft | 132/73 |
| 2007/0182572 | A1 * | 8/2007 | Rubin et al. | 340/574 |
| 2008/0035646 | A1 * | 2/2008 | Smith | 220/526 |
| 2008/0302802 | A1 * | 12/2008 | Ramsden | 220/521 |

* cited by examiner

*Primary Examiner* — Fenn Mathew
*Assistant Examiner* — E. V.
(74) *Attorney, Agent, or Firm* — Christopher Persaud

(57) ABSTRACT

A universal cap to be placed on standard containers for lip balm and lipstick that contains one or more modules that house therein functional items to assist the user for personal health and safety applications. The cap includes modules that contain space for the inclusion of identifying information, interior space for a flashlight and battery, interior space for an audio alarm, an interior space to house medication, a place for a nail file and a place for a glass breaker along with a flange to allow attachment to a lanyard or similar item.

29 Claims, 2 Drawing Sheets

CAP WITH MULTIPLE FUNCTIONALITY

REFERENCE TO PRIOR APPLICATION

This application claims priority of the provisional patent application 61/796,475, filed Nov. 13, 2012 entitled INCREDICAP—A DEVICE TO ADD TO LIP BALMS, LIP STICK AND OTHER ITEMS FOR PERSONAL SECURITY, HEART ATTACK, FIRST AID, EMERGENCY MEDICAL TREATMENT AND PERSONAL IDENTIFICATION INFORMATION, PERSONAL ASSISTANCE LIGHTING, PERSONAL SAFETY AUDIBLE AND VISIBLE ALARM by Thomas Ralph Rossi.

BACKGROUND OF THE INVENTION

1. Field of the Invention

The field of this invention relates generally to the field of personal security devices and more particularly toward a specialized cap that can be added to a standard lip balm or lip stick container that includes multiple compartments with personal assistance devices housed therein.

2. Description of the Prior Art

For protecting lips and keeping them moist and free from sun/UV damage lip balms are commonly used products that most of the consuming public is very aware of. Lip balm compositions are also included in many cosmetic lip sticks to add the function of moisturizing and UV protection. Such products for lips come in a few standard containers, i.e., either cylindrical devices that are twisted to extrude the composition upward for application or tubular devices that are squeezed to extrude the composition outward for application.

Because of the ubiquitous nature of lip balm and lip stick products, it is the object of the instant invention to provide a universal cap that can be applied to any such. container that also includes a multiplicity of personal and safety care items therein so that said. items are always available to the person in a small compact way, i.e., with their lip balm or lip stick cylinder or tube.

SUMMARY OF THE INVENTION

The basic embodiment of the present invention is a cap for a container of lip balm. or lipstick comprising: at least one module that is substantially cylindrical in shape having a closed top, an outer wall and an inner wall wherein an interior space is created between said inner wall and said closed top; threads on the bottom of said inner wall to allow said module to be screwed into another threaded surface either on said container of lip balm or lipstick or another module wherein said interior space can house a functional item to assist the holder when needed.

The above embodiment can be further modified by defining that said outer wall has sufficient space to display a telephone number or scan code containing personal information of said holder, such as identification, emergency contact. information or medical history.

The above embodiment can be further modified by defining that said interior space contains a flashlight and battery.

The above embodiment can be further modified by defining that said interior space contains an audible alarm.

The above embodiment can be further modified by defining that said interior space contains aspirin or any other medication or supplement.

The above embodiment can be further modified by defining that said closed top has a key chain loop attached thereto which can also facilitate attachment to clothing or under clothing attached like a pendant.

The above embodiment can be further modified by defining that said cap includes an auto glass breaker at said top.

The above embodiment can be further modified by defining that said cap includes a nail file that also serves as a grip enhancer on the outer surface of one of said modules.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
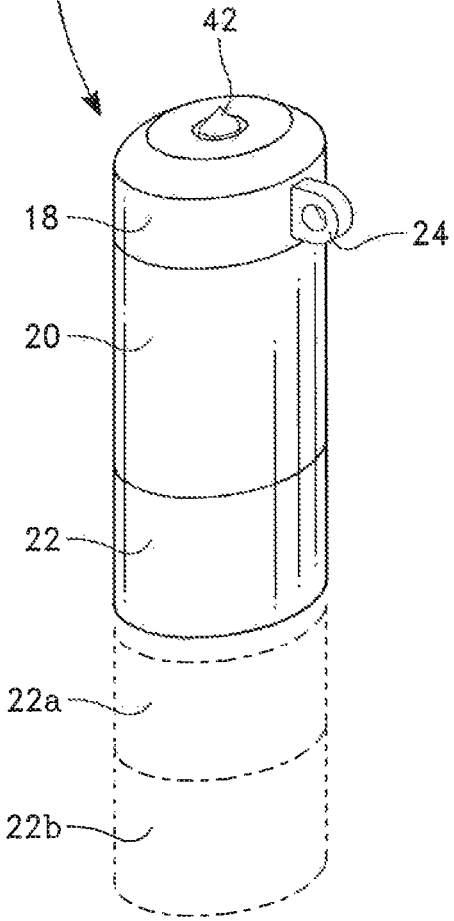
FIG. 1 is a front perspective view of the cap of the instant invention as it stands alone.

Turning to the drawings, the preferred embodiment is illustrated and described by reference characters that denote similar elements throughout the several views of the instant invention.

Figure 2:
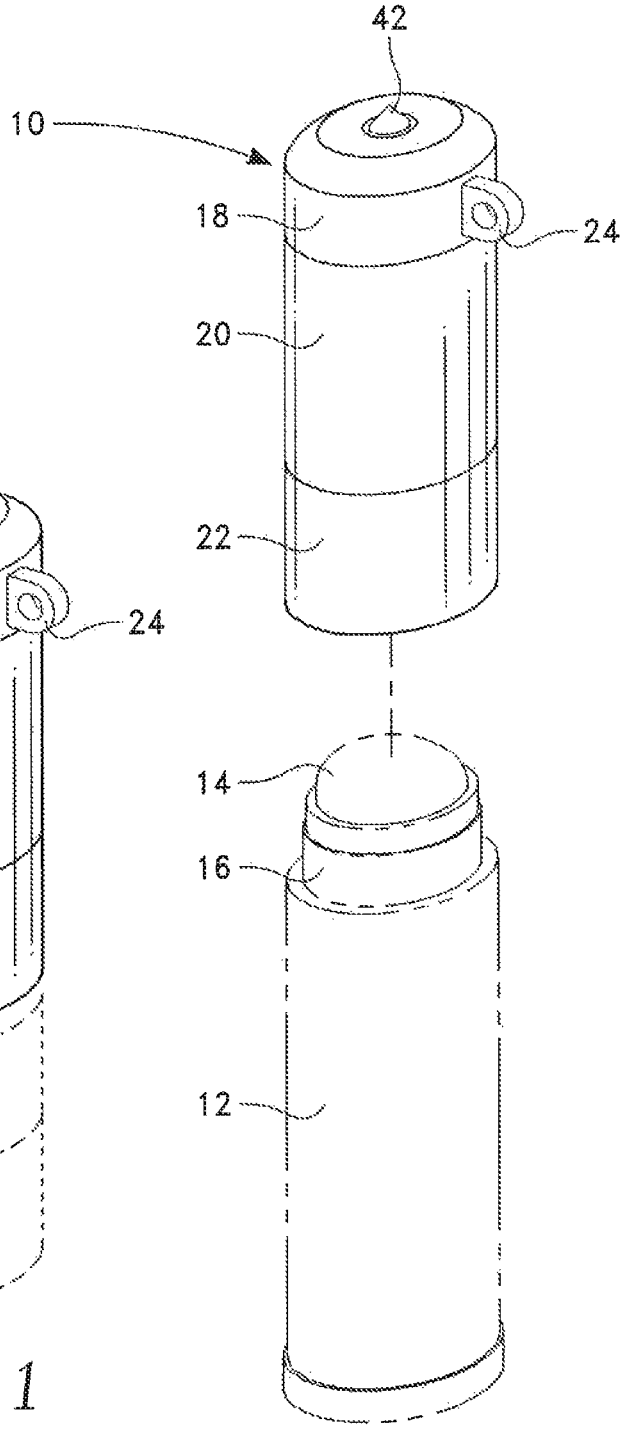
FIG. 2 is a. front perspective view of the cap of the instant invention as it sits atop a cylindrical container of lip balm.
Figure 3:
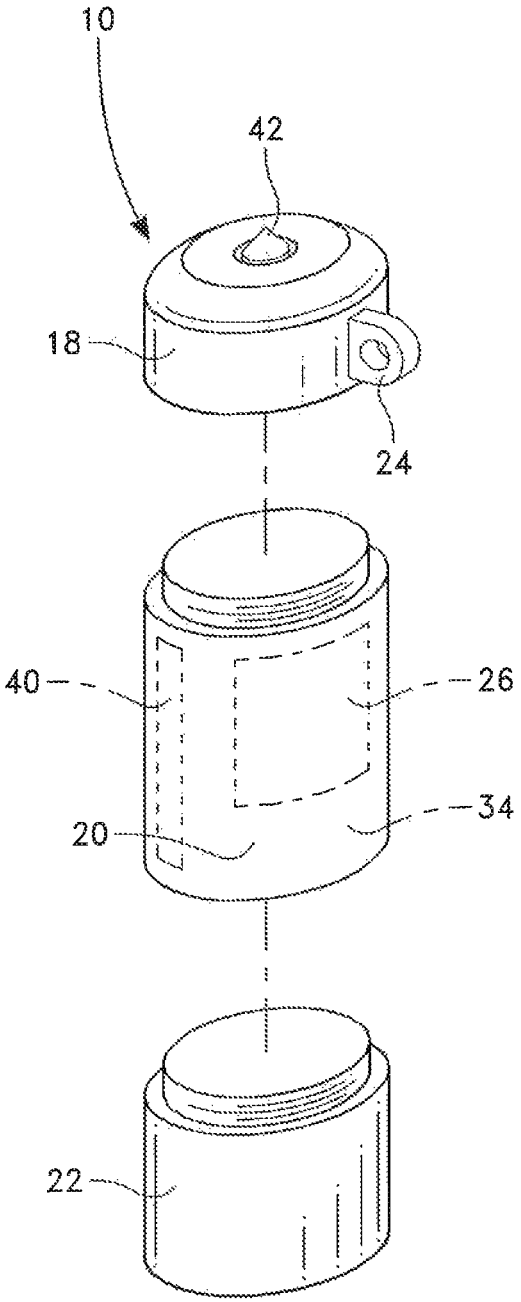
FIG. 3 is an exploded view of the modular assembly of the cap of the instant invention.
Figure 4:
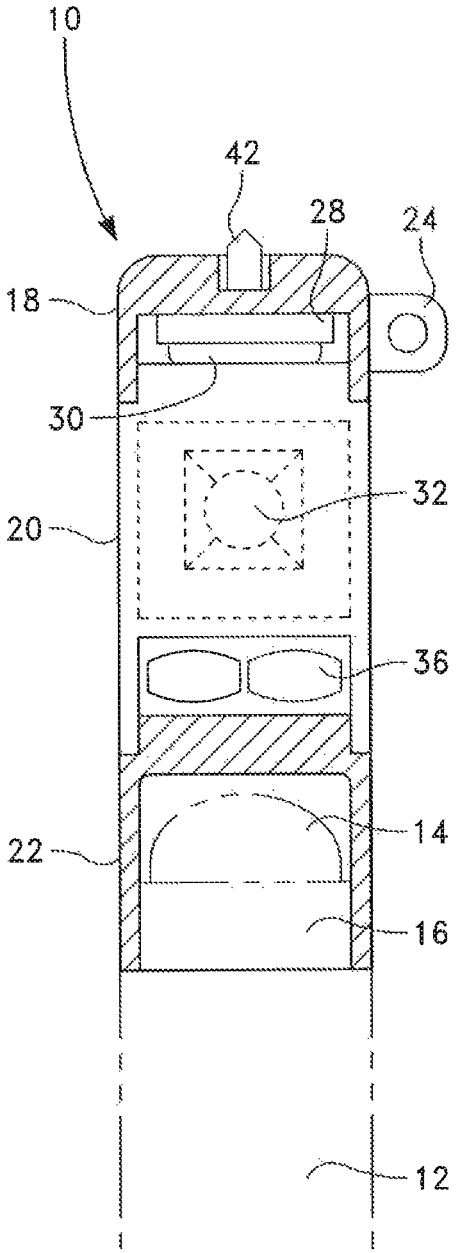
FIG. 4 is a cross-sectional side view of the cap of the instant invention.

The preferred embodiment is a cap 10 that can stand alone (FIG. 1) to replace the existing cap on a container of lip balm/lipstick 12 or can be pre-installed on same (FIG. 2). The cap 10 screws on the container (either a cylinder as shown or a tube) as the standard cap does at the top 16 of the cylinder 12 or tube where the lip material 14 emerges. The cap 10 is modular as seen in FIG. 3 and can contain one or more compartments 18, 20, 22, 22*a*, 22*b* for the inclusion therein of a series of functional items. As seen in FIG. 3, each modular component 18, 20, 22 screws on to the one below it in the same way that the cap 10 itself as a whole screws on the to the top 16 of the cylinder or tube 12.

The instant invention defines several possible functional items that can be housed in the modular portions 18, 20, 22 of the cap 10. Attached to the top portion of the cap 10 is an optional key chain loop 24 for easy storage. The top of the cap 10 can also be equipped with an attachment 42 that allows for the quick breaking of glass in the event of an emergency such as an automobile window when a driver may be trapped therein or locked outside therefrom. The functional items that can be housed in the modular components 18, 20, 22 as contemplated by this invention include 1) aspirin in the event of the onset of a heart attack or any other medications or supplements; 2) a flashlight with a battery to assist for impaired vision in the dark; 3) an audible/visible alarm in the event of an emergency; 4) identification information such as name, medical history and emergency contact; and 5) a nail file.

The order of housing in the modular components 18, 20, 22 is not important. However, the identification functional item would not be housed inside of the one of the modules, but rather would be encrypted on a scannable code or provided through a telephone number that can be called. The scannable code or telephone number would be printed on a space on the outside of one of the modules 26 and would not need to be housed therein. To be utilized, the user would have to pre-provide this information to the scanned portion or through the telephone number. Likewise, a nail file 40 would be included on the outer surface of one of the modules that can also serve as a grip assistant.

As illustrated, but not limited to this formation, the top module 18 contains a flashlight 28 with corresponding battery 30 which can he activated through an on/off switch or by the application of pressure thereto. The middle module 20 below the top module 18 is squeezable and can serve to activate the flashlight in a strobe light fashion and to set off an audible alarm 32, thereby serving as an alert in the event of an emergency. The outside surface 34 of this module 20 is one place that the scannable strip 26 or telephone number for emergency assistance can be placed.

The module 22 below the middle module 20 can house therein two to three aspirin 36 for use when the person feels the onset of a heart attack. It is to be noted that the cap can include only one of these modules, just two of these modules or all three depending on the desire of the manufacturer. Note that the bottom module 22 terminates with a threaded portion that easily screws onto the cylinder or tube of lip balm/lipstick as each module above it terminates in a threaded portion to easily screw onto the module below it.

The discussion included in this patent is intended to serve as a basic description. The reader should be aware that the specific discussion may riot explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A multi-use universal substitute cap for a container of lipstick or lip balm, which is capable of capping a lipstick or lip balm container and replacing an existing cap; and which comprises;

at least one module that is substantially cylindrical in shape having a closed top, an outer wall, and an inner wall; and a compartment space, and a compartment wall fully surrounding a compartment space, where said compartment wall is in the interior of the cap;

and a substantially cylindrical empty bottom space on the bottom of said module;

where said inner wall is partially or wholly adjoining said bottom space;

means for attachment on the bottom of said inner wall to allow said module to be attached to another surface on either said container of lip balm or lipstick or another module, or for said module to be attached as the module is placed onto the top of said lipstick or lip balm container top and connected into place atop said lipstick or lip balm container, thus attaching said module to said lipstick or lip balm container;

wherein said compartment can house a functional item;

where said substantially cylindrical empty bottom space on the bottom of said module is closed on its top end and open on its lower end, to allow said module to be attached to a surface of another container of lip balm or lipstick or another module; or for said module to be attached onto the top of said lipstick or lip balm container top and connected into place atop said lipstick or lip balm container;

and said bottom space and said module are of the correct approximate diameter that said module can be attached to a container of lipstick or lip balm, by a method through which the top of said container of lipstick or lip balm can be inserted into said bottom space;

wherein a means to break the glass of an automobile window is located in said closed top;

where said cap is of the correct size to be attached to a standard-sized lipstick container or lip balm container, through the top of said container of lipstick or lip balm being inserted into said bottom space.

2. The cap in claim 1 wherein said outer wall has sufficient space to display personal information comprising at least one of the following; identification of the holder, telephone number of the holder, identification of the holder, or emergency contact information for the holder.

3. The cap as defined in claim 1 wherein said compartment space contains a flashlight and a battery.

4. The cap as defined in claim 1 wherein said compartment space contains an audio alarm.

5. The cap as defined in claim 1 wherein said compartment space contains aspirin or other medications or supplements and wherein the maximum distance across said compartment space, on the X-axis, is less than the diameter of the bottom of said module.

6. The cap as defined in claim 1 wherein said closed top has a key chain loop attached thereto thereby facilitating easy attachment to garments or other accessories.

7. The cap as defined in claim 1 wherein a nail file is housed on said outer wall of said module.

8. The cap of claim 7 where said nail file has the additional property of being able to enhance the ability of users to grip said cap.

9. A method for supplying nearby emergency items for ready access as needed comprising the steps of: providing a multi-use universal substitute cap for a container of lip balm or lipstick, said container further comprising;

at least one module that is substantially cylindrical in shape;

having a closed top, an outer wall, and an inner wall and a compartment space, and a compartment wall surrounding said compartment space, where said compartment wall is in the interior of the cap;

and a substantially cylindrical empty bottom space on the bottom of said module;

where said inner wall is partially or wholly adjoining said bottom space; means for attachment on a bottom portion of said inner wall to allow said module to be attached to another surface either on said container of lip balm or lipstick or on another module; or for said module to be otherwise attached to said container of lip balm or lipstick or said other module;

means along the top of the cap to allow another cap of the same type to be attached to the top of the cap;

wherein said compartment space can house a functional item;

attaching said cap to an existing tube of lip balm or lipstick;

accessing said at least one module as needed.

10. The method as defined in claim 9 wherein said outer wall has sufficient space to display one of a group comprising a) personal information; b) "QR" indicia that can be scanned using a smart phone or device to reveal personal and/or medical data to authorized personnel.

11. The method as defined in claim 9 wherein said compartment space contains a flashlight and a battery for said flashlight.

12. The method as defined in claim 9 wherein said compartment space contains an audio alarm.

13. The method in claim 9 wherein such compartment space contains aspirin or other medications or supplements.

14. The method as defined in claim 9 wherein said closed top has a key chain loop attached; and said keychain loop is used to attach said module to garments or other accessories.

15. The method as defined in claim 9 wherein a means to break the glass of an automobile window in the event of an emergency is included in said closed top.

16. The method defined by claim 9 wherein a nail file is housed on said outer wall of said module.

17. A multi-use universal substitute cap which is capable of capping a container and replacing an existing cap for a container of lipstick or lip balm, and which comprises;

at least one module that is substantially cylindrical in shape having a closed top, an outer wall, and an inner wall, and a compartment space, and a compartment wall fully surrounding said compartment space, where said compartment wall is in the interior of the module; and a substantially cylindrical empty bottom space on the bottom of said module;

where said inner wall is partially or wholly adjoining said bottom space;

means along the top of the cap to allow another cap of the same type to be attached to the top of the cap;

means on a bottom portion of said inner wall to allow said module to be attached to another surface on either said container of lip balm or lipstick or another module, or for said module to be attached onto the top of said lipstick or lip balm container and connected into place atop said lipstick or lip balm container, thus attaching said module to said lipstick or lip balm container;

wherein said compartment space can house one of a group comprising aspirin, a flashlight and accompanying battery, and an audio alarm;

where said substantially cylindrical empty bottom space is on the bottom of said module and is closed on its top end and open on its lower end, to allow said module to be screwed into a threaded surface of another container of lip balm or lipstick or another module; or for said module to be attached onto the top of said lipstick or lip balm container top and connected into place atop said lipstick or lip balm container;

where said bottom space and said module are of the correct approximate diameter that said module can be attached to a container of lipstick or lip balm through a manner where the top of said container of lipstick or lip balm can be inserted into said bottom space;

where said cap is of the correct size to be attached to a standard-sized lipstick container or lip balm container, in a manner through which the top of said container of lipstick or lip balm can be inserted into said bottom space.

18. The cap of claim 17 wherein said outer wall has sufficient space to display personal information comprising at least one of the following; identification of the holder, telephone number of the holder, identification of the holder, or emergency contact information for the holder.

19. The cap as defined in claim 17 wherein said compartment space contains a flashlight and a battery.

20. The cap as defined in claim 17 wherein said compartment space contains an audio alarm.

21. The cap as defined in claim 17 wherein said compartment space contains aspirin or other medications or supplements and wherein the maximum distance across said compartment space, on the X-axis, is less than the diameter of the bottom of said module.

22. The cap as defined in claim 17 wherein said closed top has a key chain loop attached thereto, thereby facilitating easy attachment to garments or other accessories, and said key chain loop does not interfere with the ability of another cap of the same type to be attached to the top of the cap, through being screwed into the cap.

23. The cap as defined in claim 17, wherein a means to break glass, in the event of an emergency, is included in said top portion in the event of being locked out of an automobile or trapped therein, where said means to break glass is sufficiently strong to break the glass of a standard automobile window, and is also of the correct size, shape, and position that it does not impact the ability of the top of said cap to be affized to the bottom of another cap of the same type.

24. The cap of claim 17 further comprising a strobe light located on top of the closed top, where such strobe light is of the correct size, shape and position that it does not impact the ability of the top of said cap to be affixed to the bottom of another cap of the same type.

25. The cap of claim 17, further comprising that the means along the top of the cap to allow another cap of the same type to be attached to the top of the cap are threads.

26. The cap as defined in claim 17 wherein a nail file is housed on said outer wall of said module, and said nail file is also of the correct size and positioned in the correct way that it does not impact the ability of the top of said cap to be affixed to the bottom of another cap of the same type.

27. The cap of claim 26 where said nail file has the additional property of being able to enhance the ability of users to grip said cap.

28. A multi-use universal substitute cap which is capable of capping a container and replacing an existing cap for a container of lipstick or lip balm and which comprises;

at least one module that is substantially cylindrical in shape having a closed top, an outer wall, and an inner wall and a compartment space, and a compartment wall fully surrounding said compartment space, where sale compartment wall is in the interior of the cap; and a substantially cylindrical empty bottom space on the bottom of said module;

where said inner wall is partially or wholly adjoining said bottom space;

means along the top of the cap to allow another cap of the same type to be attached to the top of the cap, means on a bottom portion said inner wall to allow said module to be attached to another surface on either said container of lip balm or lipstick or another module, or for said module to be attached onto the top of said lipstick or lip balm container and connected into place atop said lipstick or lip balm container, thus attaching said module to said lipstick or lip balm container;

wherein said compartment space can house one or more of a group comprising aspirin, a flashlight and accompanying battery, and an audio alarm;

where said substantially cylindrical empty bottom space on the bottom of said module is closed on its top end and open on its lower end, to allow said module to be attached to a surface of another container of lip balm or lipstick or another module; or for said module to be attached onto the top of said lipstick or lip balm container top and connected into place atop said lipstick or lip balm container;

and said bottom space and said module are of the correct approximate diameter that said module can be attached to a container of lipstick or lip balm in a manner which allows the top of said container of lipstick or lip balm to be inserted into said bottom space;

where said cap is of the correct size to be attached to a standard-sized lipstick container or lip balm container, through a manner though which the top of said container of lipstick or lip balm can be inserted into said bottom space;

where there is sufficient room on the outside of said cap for a QR code which, when scanned, gives finders of said cap personal information about the user of the cap.

29. A multi-use universal substitute cap which is capable of capping a container and replacing an existing cap for a container of lipstick or lip balm and which comprises;

at least one module that is substantially cylindrical in shape having a closed top, an outer wall, and an inner wall and a compartment space, and a compartment wall fully surrounding said compartment space, where said compartment wall is in the interior of the cap; and a substantially cylindrical empty bottom space on the bottom of said module;

where said inner wall is partially or wholly adjoining said bottom space;

means along the top of the cap to allow another cap of the same type to be attached to the top of the cap, means on the bottom of said inner wall to allow said module to be attached to a surface on either said container of lip balm or lipstick or another module, or for said module to be attached to said lipstick or lip balm container and connected into place atop said lipstick or lip balm container, thus attaching said module to said lipstick or lip balm container;

wherein said compartment space can house at least one of a group comprising aspirin, a flashlight and accompanying battery, and an audio alarm;

where said substantially cylindrical empty bottom space on the bottom of said module is closed on its top end and open on its lower end, to allow said module to be attached to a threaded surface of another container of lip balm or lipstick or another module; or for said module to be attached onto the top of said lipstick or lip balm container top and connected into place atop said lipstick or lip balm container;

and where said bottom space and said module are of the correct approximate diameter that said module can be attached to a container of lipstick or lip balm by a method through which the top of said container of lipstick or lip balm can be inserted into said bottom space;

where said cap also contains at least one of a group comprising strobe lights and electrical power sources for strobe lights, where said cap is of the correct size to be attached to a standard-sized lipstick container or lip balm container, through a method by which the top of said container of lipstick or lip balm can be inserted into said bottom space.

* * * * *